US008322294B2

(12) United States Patent
Bowhay

(10) Patent No.: US 8,322,294 B2
(45) Date of Patent: Dec. 4, 2012

(54) OFFSHORE FRESH WATER RESERVOIR

(76) Inventor: Steven C. Bowhay, Juneau, AK (US)

( * ) Notice: Subject to any disclaimer, the term of this patent is extended or adjusted under 35 U.S.C. 154(b) by 153 days.

(21) Appl. No.: 12/980,029

(22) Filed: Dec. 28, 2010

(65) Prior Publication Data

US 2011/0155036 A1 Jun. 30, 2011

Related U.S. Application Data

(60) Provisional application No. 61/284,824, filed on Dec. 28, 2009.

(51) Int. Cl.
*B65D 88/78* (2006.01)

(52) U.S. Cl. ..... 114/256; 114/74 R

(58) Field of Classification Search ..... 114/74 R, 114/74 T, 256; 220/565, 666
See application file for complete search history.

(56) References Cited

U.S. PATENT DOCUMENTS 2,854,049 A * 9/1958 Wyllie ..... 114/256
4,506,623 A * 3/1985 Roper et al. ..... 114/256
5,657,714 A 8/1997 Hsia
6,615,759 B2 9/2003 Yaffe
7,024,748 B2 4/2006 Eagles
7,834,475 B1 11/2010 Costas

* cited by examiner

*Primary Examiner* — Lars A Olson

(74) *Attorney, Agent, or Firm* — Christensen O'Connor Johnson Kindness PLLC

(57) ABSTRACT

An offshore fresh water reservoir disposed a distance from the mouth of a river. The reservoir includes a flotation portion in the salt sea that supports a downwardly extending tubular skirt that defines a barrier. A transverse intermediate-density interface having a bulk density greater than fresh water and less than salt water is provided. The interface floats on the salt water and sinks in fresh water. In an embodiment the interface includes a plurality of balls filled with a liquid having a density corresponding to a mixture of salt water and fresh water. The reservoir is anchored in position, and includes a pumping means. In a reservoir system a curtain assembly directs the fresh water effluent to a floating blanket assembly, which further directs the effluent to a pipe that transports the effluent to the reservoir.

20 Claims, 6 Drawing Sheets

OFFSHORE FRESH WATER RESERVOIR

CROSS-REFERENCE TO RELATED APPLICATION

This application claims the benefit of Provisional Application No. 61/284,824, filed Dec. 28, 2009, the disclosure of which is hereby incorporated by reference in its entirety herein.

BACKGROUND

Shortages of fresh water, e.g., potable water and/or water for agricultural uses are being encountered more often due to increasing demands from an increasing population, and the concentration of people in large metropolitan areas. It has been estimated that by the year 2050 some four billion people will be facing sever water shortages. Such water shortages are not limited to underdeveloped countries. It is estimated that people living in southwestern states in the United States, for example, could be facing severe freshwater shortages even earlier. Even though most of the Earth's surface is covered by water, it is estimated that less than two percent of the surface water is fresh water. Shortages of fresh water are further compounded by waste and poorly managed water supplies.

Despite the many constructive uses of fresh river water everywhere, a large amount of fresh river water flows into the world's oceans every day. Many regions, municipalities, agricultural users, and the like divert or otherwise contain large quantities of fresh river water in reservoirs which are typically located near the source of the water. However, large fresh water reservoirs are very expensive to build and maintain, and require large regions of land that might be put to other productive uses. Moreover, suitable locations for such large reservoirs are clearly limited.

A significant proportion of the population is located near the ocean or other major bodies of salt water. The salt water is generally not potable, of course, although large quantities of fresh water regularly flow into the bodies. Typically, the flow of fresh water in rivers is very seasonal, and seasonal flow forecasting is an important undertaking for most water supply systems. The seasonality of river flows is due to the seasonality of rainfall, as well as the availability of other watershed resources such as snow accumulations.

Typically, during times of high water flow fresh water is abundantly available to fill local needs, but when the water flow drops off severe fresh water shortages can occur. It would be useful to store fresh water river effluent from periods of high water flow, for use during times of low water flow.

Also, in certain regions near bodies of salt water and without an adequate fresh water source, water desalination plants are used to extract fresh water from the salt water body. In order to run the desalination plants at peak efficiency, while ensuring a stable supply of fresh water, it is desirable to have a reservoir to store fresh water that is produced, for purposes of load leveling and to accommodate periods of equipment maintenance.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An offshore fresh water reservoir is disclosed that includes a flotation member, for example an annular foam and/or air-filled bladder, that defines a closed perimeter, and a pliable, tubular skirt that extends downwardly from the flotation member, to define a volume. A density interface assembly in disposed in the volume, and is formed from one or more members having a gross density such that the members float in salt water and sink in fresh water. For example, the density interface member(s) may be formed by filling a container with a mixture of sea water and fresh water. An anchor system is provided to fix the location of the offshore fresh water reservoir.

In an embodiment the offshore fresh water reservoir is sized to contain at least ten million cubic meters of fresh water, and the density interface assembly comprises a large plurality of intermediate buoyancy spherical containers filled with salt water.

In an embodiment the offshore density interface assembly includes an impermeable sheet that is configured to degrade over time.

In an embodiment, the reservoir further comprises a system for supplying fresh water to the reservoir, for example a conduit system that extends from the mouth of a river to the offshore reservoir. The conduit system may comprise a floating blanket system with a U-shaped bladder and/or a wave-powered pumping station for pumping fresh water into the reservoir.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
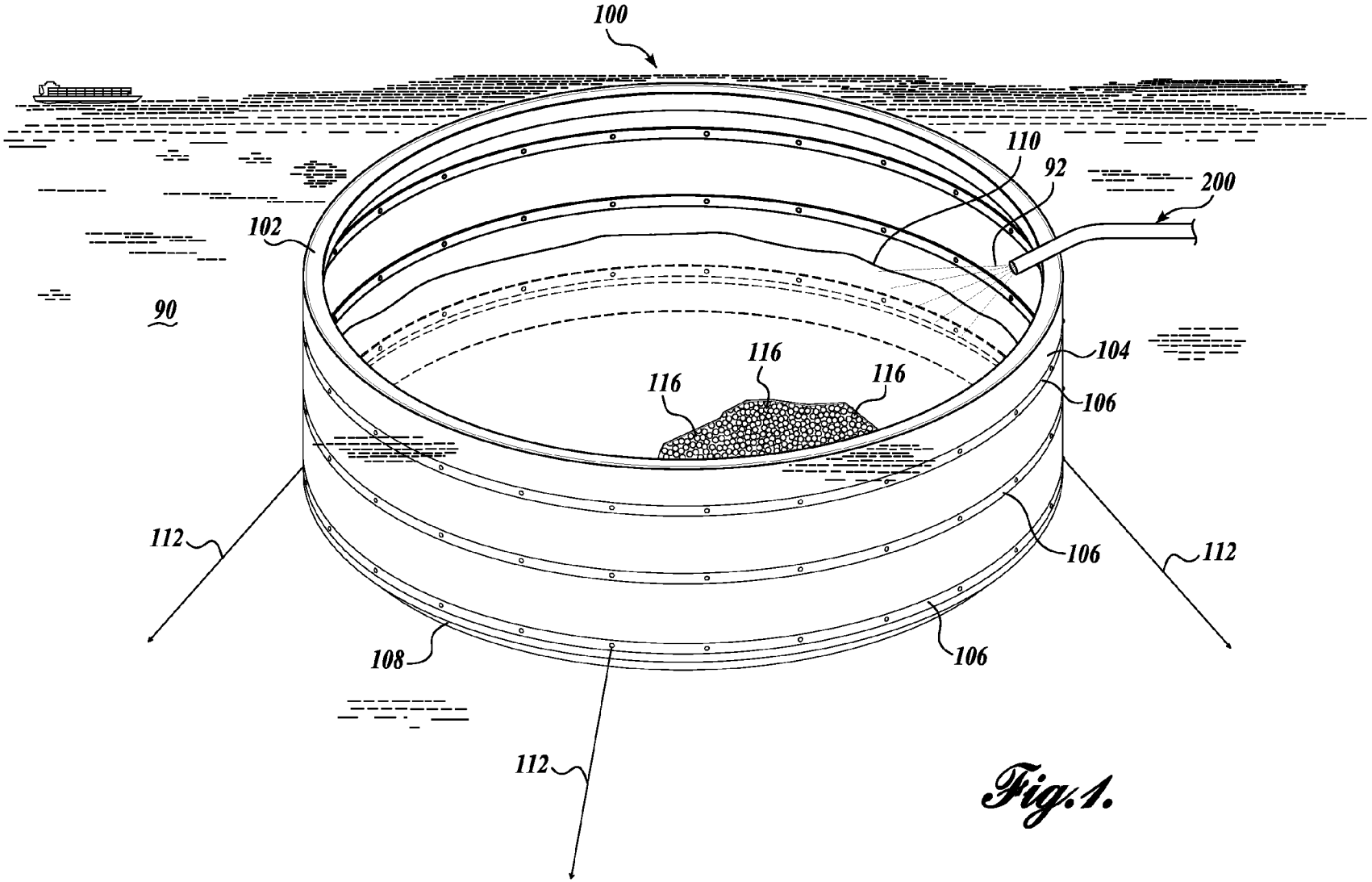
FIG. 1 shows a sketch of a first embodiment of an offshore fresh water reservoir in accordance with the present invention.

Offshore fresh water reservoirs in accordance with the present invention will now be described with reference to specific embodiments as illustrated in the figures wherein like numbers indicate like parts. FIG. 1 is a perspective view of an offshore fresh water reservoir 100 disposed in a saltwater environment or sea water 90, for example, in an ocean some distance from the shore (not shown). The reservoir 100 includes an upper flotation portion 102 that extends above the waterline, and a pliable, downwardly extending skirt 104.

The flotation portion 102 in the current embodiment is formed as an annular-shaped polymeric foam tube encased in a saltwater resistant covering. Other light-weight constructions, for example, an inflatable tube, an inflatable tube with a foam insert, or the like, are also contemplated. Alternatively, the flotation portion 102 may comprise a more rigid structure, for example, a sealed metal or polymeric assembly that encloses a low density material or foam or air. In another contemplated embodiment, the flotation portion is formed as a reinforced concrete pontoon structure, as is known in the art. The flotation portion 102 is preferably shaped to provide a support platform to accommodate other equipment or components, such as filtering components, walls or barriers, aesthetic features, etc. and/or to provide a work platform for maintenance.

The pliable or compliant skirt 104 extends downwardly into the sea water 90 from the flotation portion 102, and may be provided with weights (not shown) to facilitate deployment and maintenance of the skirt 104. The skirt 104 is water impermeable, and is tubular such that the skirt 104 defines a barrier within the sea water 90. Optionally, one or more hoop supports 106 may be fixed to the skirt 104, to maintain or encourage a desired transverse shape for the skirt 104. For example, if the flotation portion 102 and the skirt 104 are circularly configured as indicated in FIG. 1, the stiff supports 106 are also circular hoops that help to maintain the skirt 104 in a right circular cylinder arrangement. If course, the flotation portion 102 and skirt 104 may be shaped with a cross-section that is not circular. For example, if multiple reservoirs are to be constructed in a modular fashion it may be preferable to utilize a square or hexagonal cross section. In the currently preferred embodiment the distal end of the skirt 104 comprises a distal tapered portion 108 for stability.

One or more anchor assemblies 112 are attached to the reservoir 100, for example, to one or more of the supports 106, if present, or to the flotation portion 102. The anchor assemblies 112 extend down to engage a fixed geological feature such as the sea floor to anchor the reservoir at the desired location. It is contemplated that one or more piles, caissons, or the like (not shown), may be installed in the sea floor to provide a secure and precisely located anchor attachment point.

A floating interface assembly 110 is provided within the volume defined by the skirt 104, and extends transversely across the skirt 104, as discussed in more detail below (and illustrated in more detail in FIG. 2). A source of fresh water 92 is provided to supply the offshore fresh water reservoir 100. The source of fresh water 92 may be transported to the reservoir 100 in any suitable manner. Exemplary systems for transporting fresh water 92 to the reservoir 100 are described below.

Figure 2:
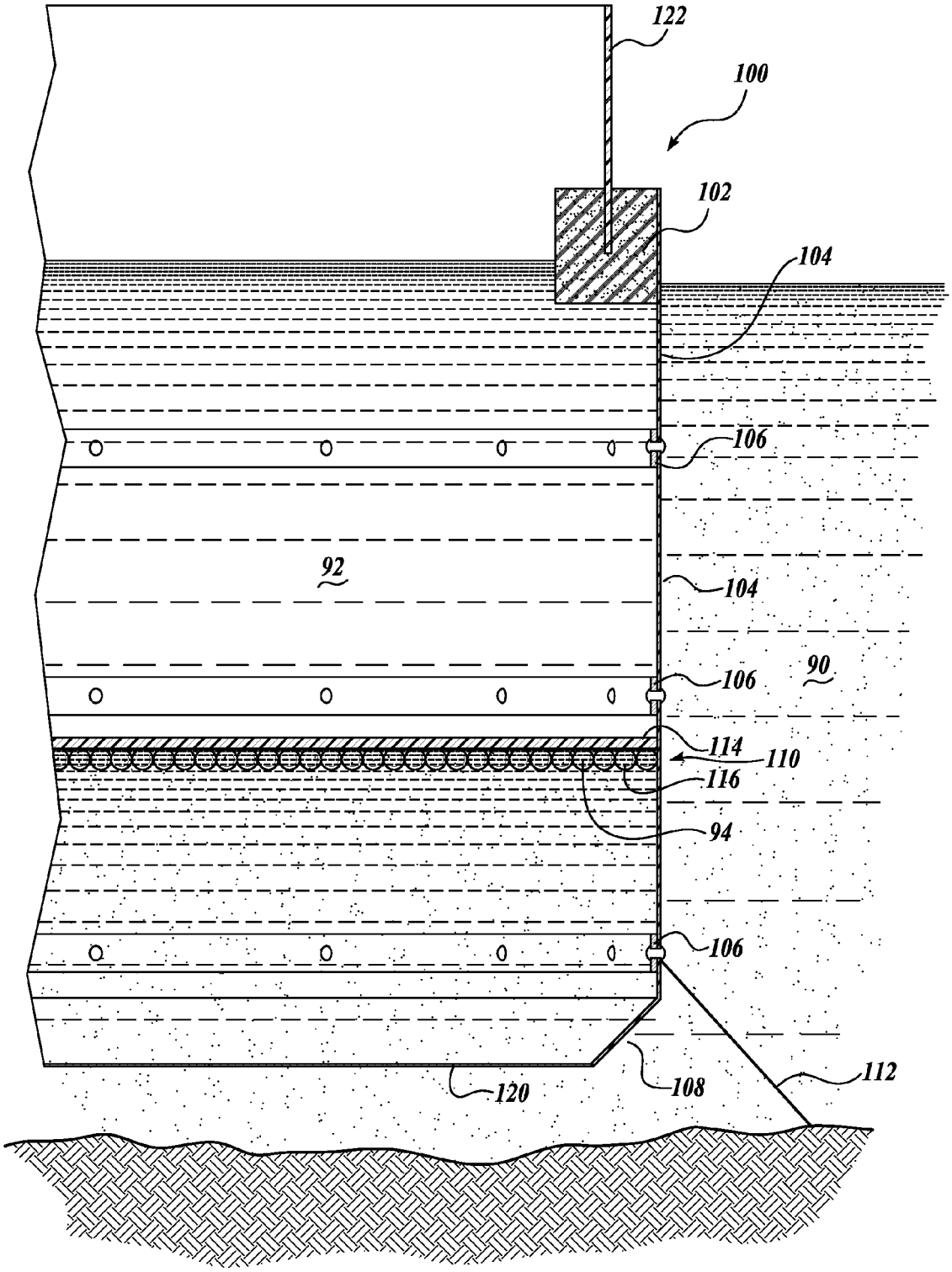
FIG. 2 shows a detail view of the offshore fresh water reservoir shown in FIG. 1.

Refer now also to FIG. 2, which shows a fragmentary cross-section view of the reservoir 100. The floating interface assembly 110 of this embodiment comprises a closely packed plurality of buoyancy members 116. For example, the buoyancy members 116 may comprise spheres, (e.g., hollow plastic balls), that are filled with an intermediate-density fluid 94 having a density that is between the density of the fresh water 92 and the density of sea water 90. In a preferred embodiment, the buoyancy members 116 are filled with a liquid comprising between 40-60% fresh water and between 60-40% sea water (or the equivalent density salt water).

The buoyancy members 116 are therefore constructed to be buoyant in the sea water 90 and to sink in the fresh water 92. Therefore, the buoyancy members 116 will naturally equilibrate to an interface between the fresh water 92 and the salt water 90 within the reservoir 100. A panel or sheet 114, preferably a water-impermeable or water-resistant sheet, may be provided on top of the buoyancy members 116, and extends transversely across the reservoir 100. The sheet 114 is primarily useful to facilitate filling the reservoir 100 with fresh water 92, without undue mixing of the fresh water with the sea water. However, after the reservoir 100 is sufficiently filled with fresh water, for example, when the fresh water column is twenty feet deep or more, the sheet 114 may be removed. It is contemplated, for example, that the sheet 114 may be selected from a material that will gradually degrade over time and sink to the sea floor such that the buoyancy members 116 remain to define the interface between the fresh water and the salt water.

When the sheet 114 is removed, the closely packed buoyancy members 116 provide a self-locating barrier between the fresh water and the salt water. However, if a relatively dense object or small particles fall into the reservoir 100 and sink, they may readily pass between buoyancy members 116. The buoyancy members 116 also provide an automatic filtering function. As sediment or other particulates sink in the fresh water 92 they will tend to accumulate on the buoyancy members 116. The top of the buoyancy members 116 will therefore eventually tend to get heavier due to such deposits, and will tend to flip over, such that the particulates will drop off and sink to the sea bed. It will also be appreciated that although a single layer of buoyancy members are shown, it is contemplated that more buoyancy members 116 may be provided such that the buoyancy members 116 may be stacked on average two or more members deep.

The bottom of the skirt 104 is preferably closed with a mesh or netting material 120 which permits debris to fall therethrough, prevents or deters fish and the like from entering the reservoir, and facilitates the skirt 104 keeping the desired shape.

Also visible in FIG. 2 is an annular wall 122 that is preferably affixed to, and extends upwardly from the flotation portion 102. The annular wall 122 shields the reservoir 100 to prevent sea water from cresting over the flotation portion 102 into the reservoir 100, and prevents or deters sea animals from entering the reservoir 100. A covering (not shown) may also be provided, and fixed to the top end of the annular wall 122 to provide a covering for the reservoir 100.

It will be appreciated that the reservoir 100 in accordance with the present invention will readily scale to very large sizes. Because the reservoir 100 is located offshore, the reservoir will not interfere with other land uses, and is believed to present minimal environmental impacts even at large sizes. In particular it is contemplated that the reservoir may be readily designed to have a capacity in the range of 10 million cubic meters to 10,000 million cubic meters or more. As suggested above, in some situations it may be desirable to cluster two or more separate reservoirs 100 at a particular location, for example, to facilitate maintenance of the system, or to gradually increase total capacity of a reservoir system.

Figure 3:
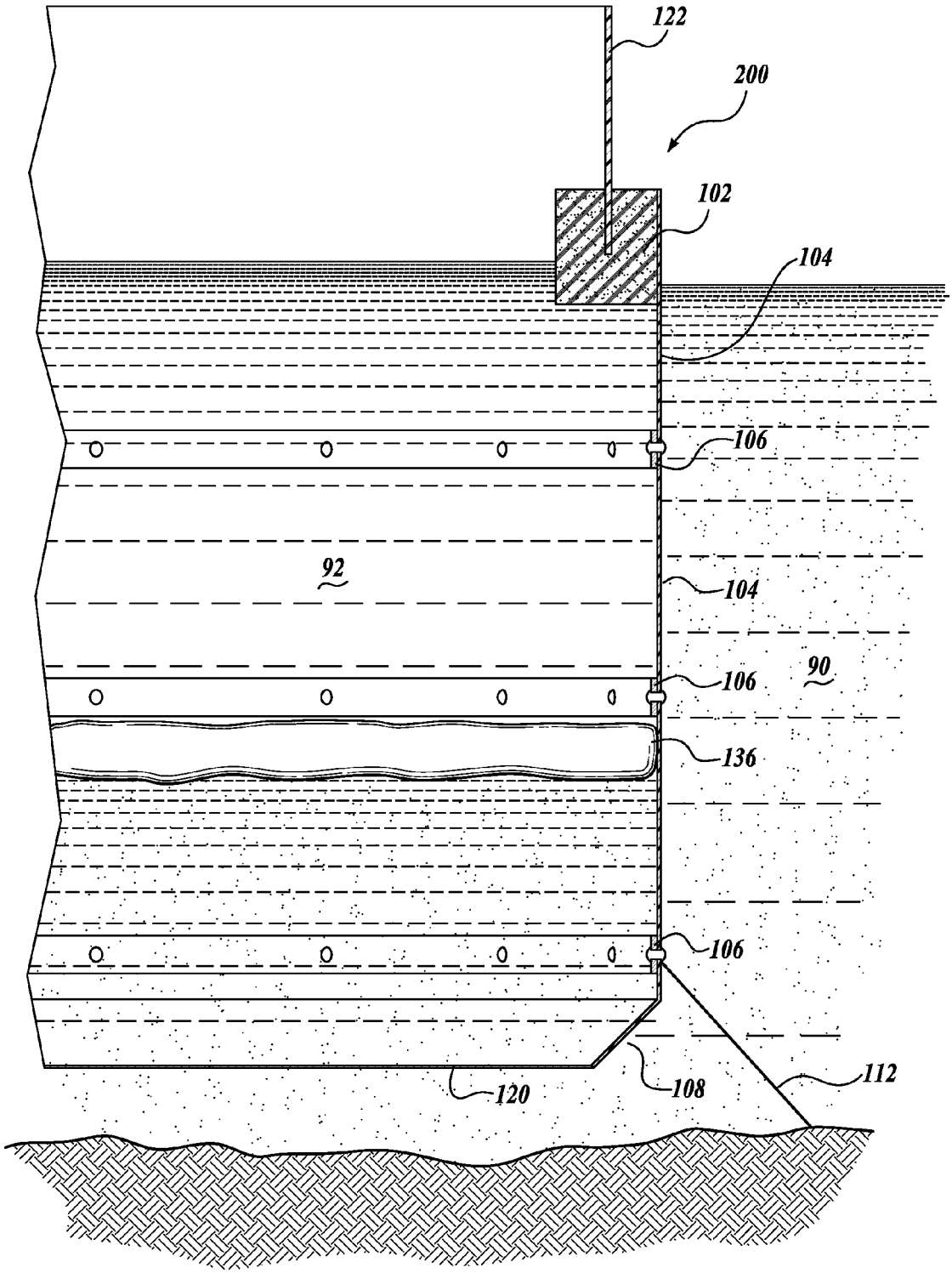
FIG. 3 shows a detail view showing an alternative embodiment for the fresh water reservoir shown in FIG. 1.

FIG. 3 shows an alternative embodiment wherein the individual buoyancy members 116 and sheet 114 are replaced with a unitary pliable buoyancy member 136 that extends transversely across the reservoir 100 and is configured to have a density between that of fresh water and sea water, such that the unitary buoyancy member 136 will naturally locate at the interface between the fresh water and the sea water. The unitary buoyancy member 136 may comprise, for example, a large polymeric bladder filled with a mixture of fresh water and sea water. Of course, it is contemplated that the buoyancy member 136 may comprise a plurality of adjacent bladders, for example, the buoyancy member 136 may comprise 8-24 individual pie-shaped bladders that cooperatively define an interface between the fresh water and the salt water.

Figure 4:
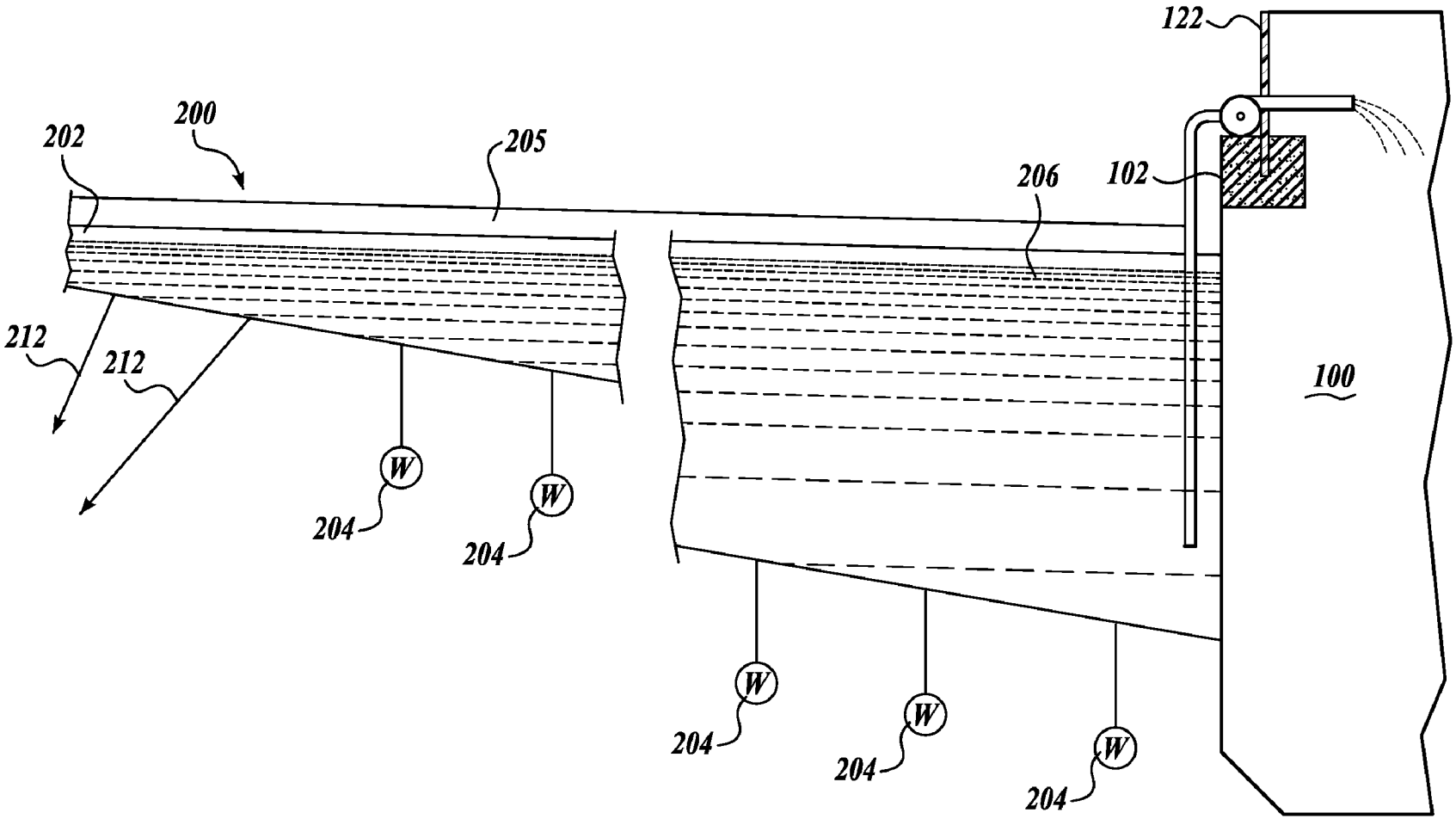
FIG. 4 is a side view of a floating curtain system for directing fresh water, for example, river effluent towards the reservoir shown in FIG. 1.

As discussed above, the fresh water may be transported to the reservoir 100 in any convenient manner. In a currently preferred embodiment, as shown in FIG. 4, a flexible floating curtain system is provided comprising oppositely disposed curtains 200. The curtains 200 are preferably anchored and suspended to generally follow the contour of the sea floor, and spaced from the sea floor by at least three feet. An elongate buoyant upper member 205 supports a top edge of the curtains 200. A proximal end portion 202 of each curtain 200 is located at the mouth of a river and anchored below the high tide line, to intercept and direct a portion of the fresh water effluent towards the reservoir 100. The floating curtain system 200 may define a channel. The curtain system may extend to the reservoir 100 as shown in FIG. 4. More preferably, the curtain system extends a relatively short distance to an intermediary transport system, as discussed below and shown in FIG. 6.

The curtain system 200 includes anchor assemblies 212 that maintain the floating curtain system 200 at a desired position, and a plurality of weights 204 at spaced locations along the length of the curtain system 200. In the embodiment of FIG. 4, a distal end portion 206 of the fresh water curtain 200 extends to, and may engage, the reservoir 100. As fresh water effluent flows into the volume defined by the curtain system 200 it is thereby maintained separate from the salt water by the fresh water curtain 200. A pumping apparatus 208, preferably a wave-powered pumping system, transfers fresh water into the reservoir 100.

Figure 5:
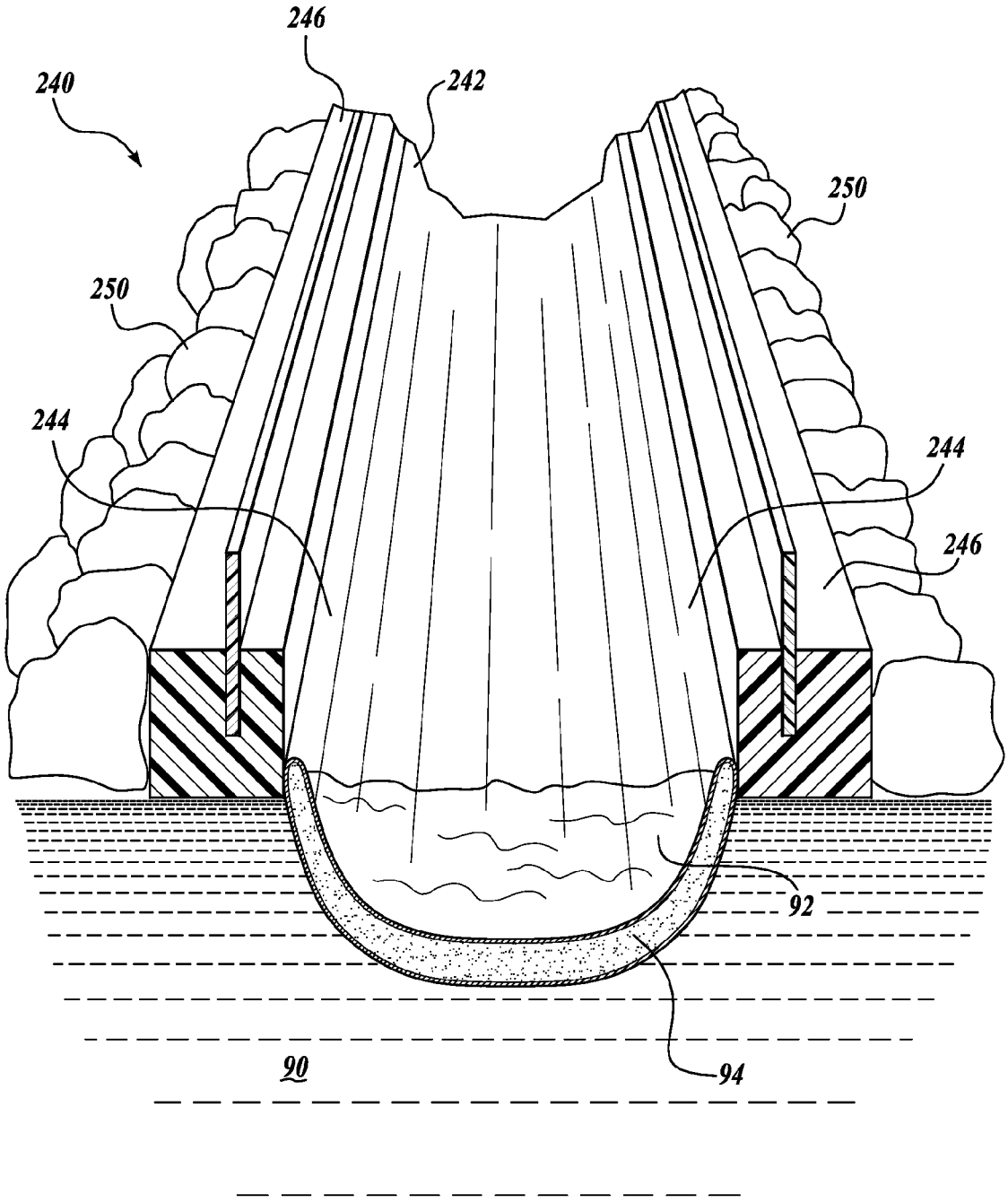
FIG. 5 shows a detail cross-sectional view of a channel system in accordance with the present invention that may be used to further direct the fresh water effluent towards the reservoir.

Another water channel apparatus is shown in FIG. 5 that is referred to herein as a water blanket system 240. The water blanket system 240 includes an elongate flexible tubular bladder 242 that encloses an intermediate-density fluid 94 having a density between the density of fresh water and the density of salt water, for example, a mixture of fresh water and salt water. The tubular bladder 242 is generally U-shaped having opposite longitudinal edges 244 that are fixedly attached to spaced-apart flotation beams 244 that are floating in the salt water 90. The flotation beams 246 may be fitted with one or more anchor systems (not shown) to anchor the flotation beams 246 at a desired location. The flotation beams 246 may be constructed in a manner similar to the flotation portion 102 of the reservoir 100 as described above. For example, the flotation beams 246 may comprise a polymeric foam material enclosed in a polymeric sheath.

It will be appreciated that the tubular bladder 242 filled with the intermediate-density fluid 94 will tend to float on the salt water 90, but tend to sink under the fresh water 92. Therefore, the gravitational stressors on the tubular bladder 242 from the volume of fresh water 94 over the bladder 242 will be relatively minor.

In the currently preferred embodiment, opposite walls 248 extend upwardly from the flotation beams 246 to shield the fresh water 92 from encroachment by sea water or other foreign debris. It is also contemplated that real or faux rockery 250 may be fixed to the flotation beams 246 to provide an aesthetically pleasing appearance of a rocky shoal or the like.

Figure 6:
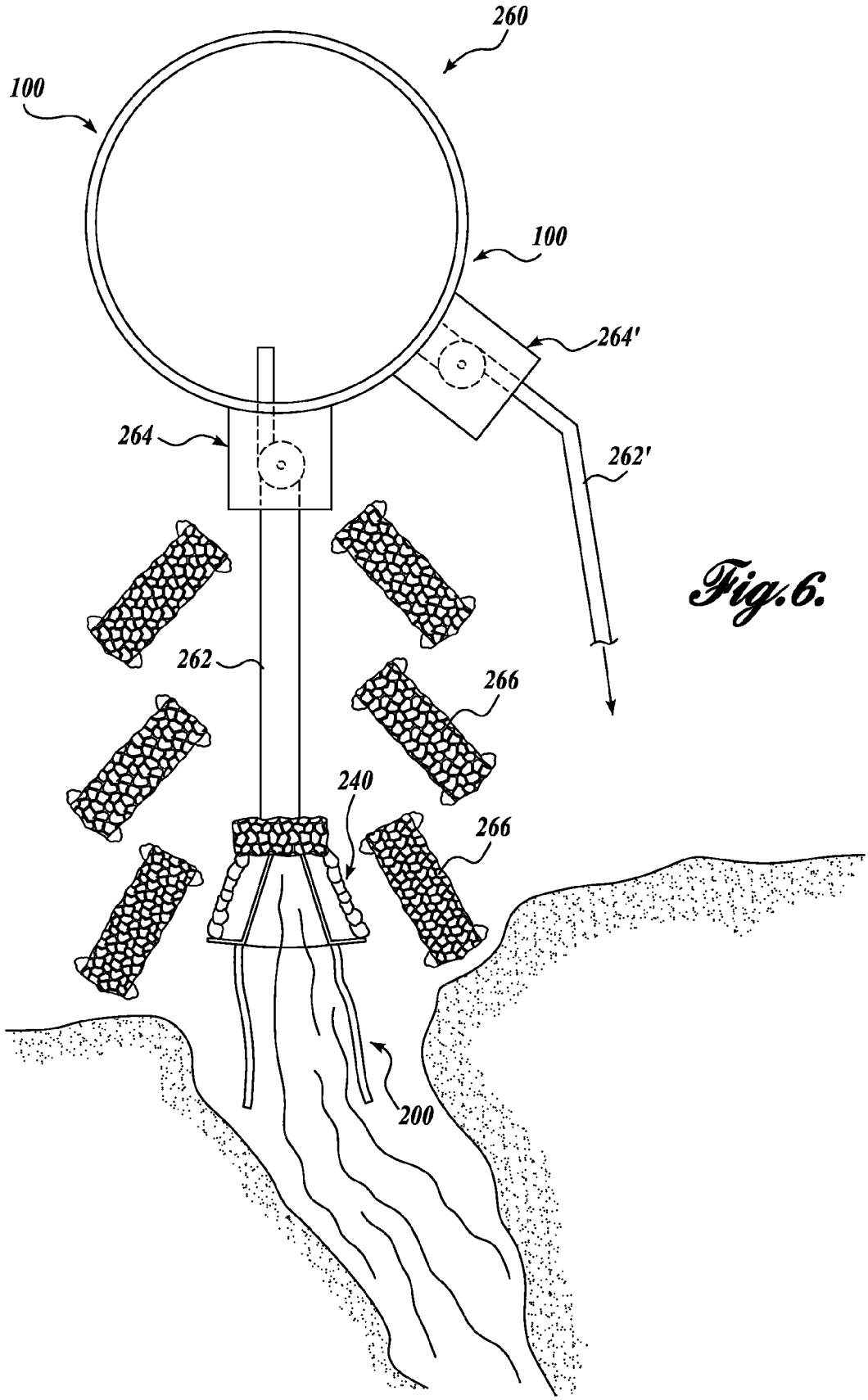
FIG. 6 shows schematically a currently preferred fresh water reservoir and supply system in accordance with the present invention for providing an offshore freshwater reservoir filled with fresh water captured from the effluent from a river.

FIG. 6 shows an exemplary fresh water reservoir system 260 incorporating the offshore fresh water reservoir 100 shown in FIG. 1, a floating curtain system 200 similar to that shown in FIG. 4, and the water blanket system 240 shown in FIG. 5. In this system 260 the floating curtain system 200 directs a portion of the fresh water effluent from a river towards the water blanket assembly 240. Water entering the blanket assembly 240 is guided towards an underwater pipe 262 that is oriented at a downward angle towards the reservoir 100, such that the fresh water will flow towards the reservoir 100 by gravity. It is contemplated that the flow may alternatively or additionally be assisted with a pumping system at the distal end of the blanket assembly 240 (not shown). A pumping station 264 located at or near the reservoir pumps the fresh water into the reservoir 100. In a current embodiment, one or more shoals 166 (six shown), which may be floating shoals 266, are further provided and positioned to partially protect the system from sea waves and the like, and to also provide an aesthetically pleasing system.

The same pumping station 264, or a second pumping station 264' would then pump fresh water back to the user through underwater pipe 262', for example, to one or more municipal and/or agricultural water supply system. The present system provides a large offshore reservoir that may be filled with seasonal or irregularly available fresh water effluent that would otherwise flow directly into the salt water environment 90.

Although the exemplary reservoir system 260 captures river effluent to stock the reservoir 100, it is contemplated that the reservoir 100 may be alternatively filled. For example, it is contemplated that the reservoir 100 may provide a reservoir for a desalination plant, wherein fresh water is extracted from the sea water, and is stored in the reservoir 100. In another contemplated application, in regions where waterfall is intense for a relatively short period of time, for example, in regions that are subject to seasonal monsoons, the waterfall may be collected and stored in the reservoir 100, for use during the dry seasons.

While illustrative embodiments have been illustrated and described, it will be appreciated that various changes can be made therein without departing from the spirit and scope of the invention.

The embodiments of the invention in which an exclusive property or privilege is claimed are defined as follows:

1. An offshore fresh water reservoir comprising:

a flotation member configured to float in sea water, the flotation member defining a closed perimeter;

a tubular skirt attached to the flotation member and extending vertically downward from the closed perimeter to define a volume, wherein the tubular skirt is formed from a pliable material;

a density interface assembly disposed in the volume and extending transversely to divide the volume into an upper portion and a lower portion, wherein the density interface assembly has a density between the density of the sea water and the density of fresh water; and an anchor system that is configured to fix the location of the offshore fresh water reservoir.

2. The offshore fresh water reservoir of claim 1, wherein the volume defined by the water barrier is at least ten million cubic meters.

3. The offshore fresh water reservoir of claim 1, wherein the density interface assembly comprises a plurality of intermediate buoyancy members, wherein each intermediate buoyancy member has a density between the density of the sea water and the density of fresh water.

4. The offshore fresh water reservoir of claim 3, wherein the intermediate buoyancy members are spherical.

5. The offshore fresh water reservoir of claim 3, wherein the intermediate buoyancy members comprise plastic containers filled with salt water.

6. The offshore fresh water reservoir of claim 3, wherein the density interface assembly further comprises a water-impermeable sheet that is disposed over the plurality of intermediate buoyancy members.

7. The offshore fresh water reservoir of claim 6, wherein the impermeable sheet is configured to degrade over time during use.

8. The offshore fresh water reservoir of claim 1, further comprising a means for supplying fresh water to the reservoir.

9. The offshore fresh water reservoir of claim 8, wherein the means for supplying fresh water to the reservoir comprises a conduit system extending from the mouth of a river to the skirt.

10. The offshore fresh water reservoir of claim 9, wherein the conduit system comprises a floating curtain system comprising at least two spaced apart curtains that extend downwardly from the sea surface to near the sea floor, and extend longitudinally to direct fresh water effluent towards the reservoir.

11. The offshore fresh water reservoir of claim 9, wherein the conduit system comprises a floating blanket system comprising a pair of spaced apart flotation members that support a U-shaped bladder therebetween, wherein the U-shaped bladder is configured to direct fresh water effluent towards the reservoir.

12. The offshore fresh water reservoir of claim 11, wherein the U-shaped bladder is at least partially filled salt water having a density greater than fresh water and less than the sea water.

13. The offshore fresh water reservoir of claim 9, wherein the conduit system further comprises a pumping station for pumping fresh water into the reservoir.

14. The offshore fresh water reservoir of claim 13, wherein the pumping station comprises at least one wave-powered pump.

15. A fresh water reservoir configured to be located in the sea, the reservoir comprising:

an annular flotation member;

a flexible curtain having a top end fixed to the annular flotation member and a bottom end adapted to be anchored to a sea floor, the flexible curtain enclosing a tubular volume that is open at the top and bottom;

a density interface assembly disposed in the tubular volume, wherein the density interface assembly is positively buoyant in the sea and is negatively buoyant in fresh water.

16. The fresh water reservoir of claim 15, wherein the density interface assembly comprises an array of separate balls that are filled with salt water.

17. The fresh water reservoir of claim 16, wherein the density interface assembly further comprises panel that extends transversely across the tubular volume and is disposed over the array of separate balls.

18. The fresh water reservoir of claim 16, wherein the balls are spherical.

19. The fresh water reservoir of claim 15, wherein the tubular volume is at least ten million cubic meters.

20. The fresh water reservoir of claim 15, further comprising a plurality of support hoops that engage the flexible curtain.

* * * * *